United States Patent [19]

McDonald et al.

[11] Patent Number: 4,864,969

[45] Date of Patent: Sep. 12, 1989

[54] PRESSURIZED FLUID BED HOT GAS DEPRESSURIZATION SYSTEM

[75] Inventors: Dennis K. McDonald, NW. Massillon; Paul S. Weitzel, Canal Fulton; Bernard M. McCoy, Medina, all of Ohio

[73] Assignee: The Babcock & Wilcox Company, New Orleans, La.

[21] Appl. No.: 228,893

[22] Filed: Aug. 5, 1988

[51] Int. Cl.[4] ..... F22B 1/00; F22B 37/24

[52] U.S. Cl. ..... 122/4 D; 122/504; 122/506; 110/185

[58] Field of Search ..... 432/58; 122/4 D, 504, 122/504.1, 506, 507; 110/185, 193, 245, 263; 60/39.464

[56] References Cited

U.S. PATENT DOCUMENTS

| | | | |
|---|---|---|---|
| 2,699,041 | 1/1965 | Rowand et al. | 122/506 |
| 4,584,949 | 4/1986 | Brannstrom | 122/4 D |
| 4,589,841 | 5/1986 | Bergkvist | 122/4 D |
| 4,622,922 | 11/1986 | Miyagaki et al. | 122/4 D |
| 4,827,723 | 5/1989 | Engstrom et al. | 122/4 D |

*Primary Examiner*—Henry C. Yuen

*Attorney, Agent, or Firm*—Robert J. Edwards

[57] ABSTRACT

A depressurization apparatus which utilizes a plurality of rupturable discs connected to lines that communicate with a conduit conveying hot gas from a pressurized fluid bed reactor to a turbine. Whenever depressurization is required due to excessive pressure in the conduit or for another reason, one or more rupturable discs are electrically fired to vent the gas to atmosphere. A separate isolation valve is provided for each disc, and can be closed to facilitate the replacement of a ruptured disc without having to shutdown the reactor.

5 Claims, 1 Drawing Sheet

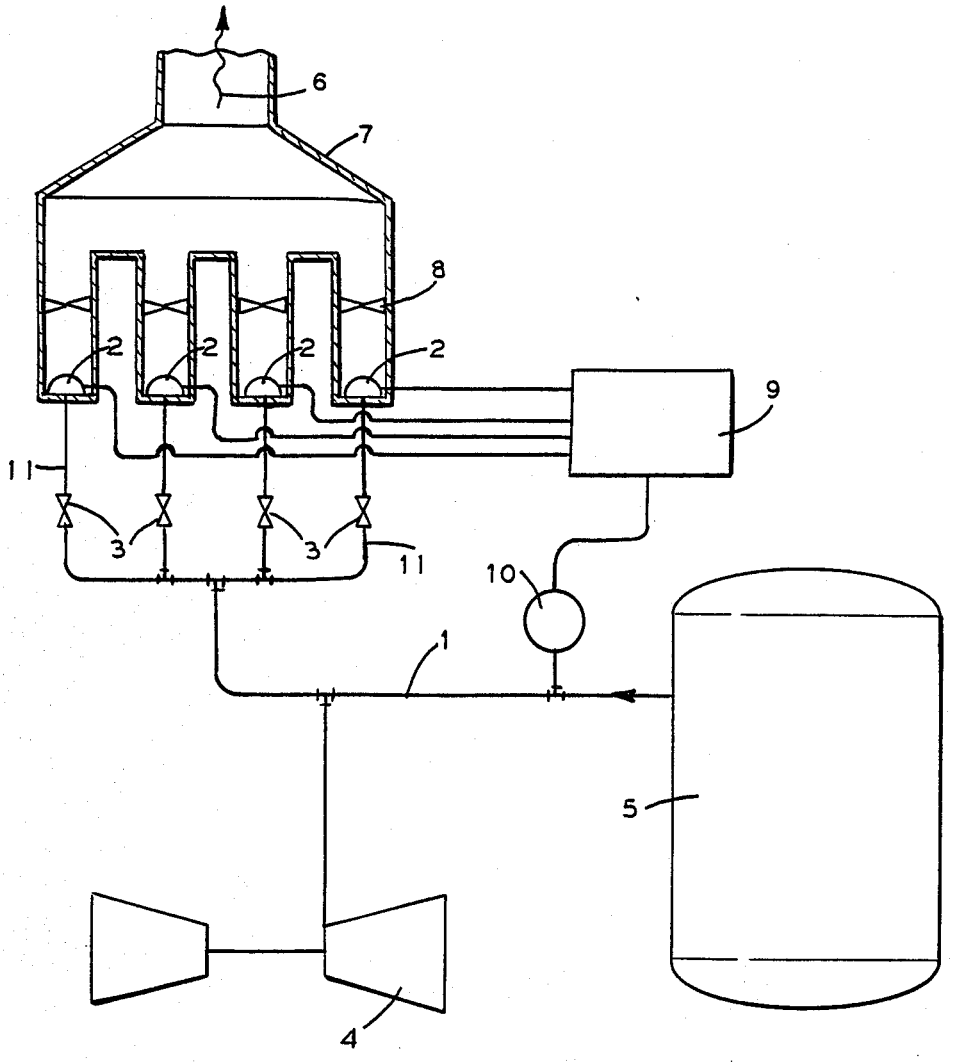
6
7
8
2
2
2
2
9
11
3
3
11
10
1
5
4

PRESSURIZED FLUID BED HOT GAS DEPRESSURIZATION SYSTEM

FIELD AND BACKGROUND OF THE INVENTION

The present invention relates in general to pressurized fluidized bed boilers, and in particular, to a new and useful depressurization system for quickly and safely depressurizing the pressure vessel of such boilers.

Various types of fluidized bed boilers exist which are distinguished by the pressure and velocity of fluidizing gas used in the boiler. Bubbling fluidized bed boilers utilize relatively low fluidizing gas velocities. Higher gas velocities are used in turbulent fluidized bed boilers. Even greater gas velocities are used in fast fluidized bed boilers.

A Babcock and Wilcox Technical Paper entitled "The Fast Fluidized Bed—A True Multi-Fuel Boiler" by Lars Stromberg et al, presented to the Eight International Conference on Fluidized-Bed Combustion in Houston, Tex., on Mar. 18–21, 1985, outlines the different types of fluidized bed boilers.

Fluidized bed boilers are also distinguished by the pressure at which they operate. Atmospheric fluidized bed boilers operate at or near atmospheric pressure. These type of boilers do not require an enclosure in the form of a pressure vessel. Pressurized fluidized bed boilers, on the other hand, operate at elevated pressures. U.S. Pat. No. 4,584,949 to Brannstrom discloses a pressurized fluidized bed reactor having a combustion chamber and a storage container housed within a pressure vessel. The upper end of the container is provided with a pressure relief line and valve and a conduit which is connected to receive bed material from the combustion chamber. To remove bed material from the combustion chamber, the pressure relief valve is opened. The internal pressure in the combustion chamber then forces bed material into the container. A throttle valve is connected to the pressure relief line so that any leakage through the relief valve is satisfied by the pressurized gas within the container, rather than by the gas of the combustion chamber. However, this reference does not disclose a depressurization system which can be used as a safety feature for quickly and efficiently depressurizing the pressure vessel in case of an emergency.

Fast fluidized bed boilers which are also operated at elevated temperatures are disclosed by U.S. Pat. No. 4,538,549 to Stromberg and U.S. Pat. No. 4,548,138 to Korenberg.

U.S. Pat. No. 4,546,709 to Astrom discloses a pressurized, fluidized bed reactor having a cyclone separator arrangement for removing particles from the hot exhaust gases of a combustor so that the exhaust gases can be lead to a turbine to drive the turbine. This patent, which is incorporated herein by reference, teaches the enclosure of the furnace within a vessel operated at super-atmospheric pressure.

Hot gas blowoff systems are known to utilize valves that can be opened to vent high temperature and dust-laden gases from the combustion chamber within the pressurized vessel. Cold depressurization systems are also known which vent hot air from the pressure vessel to the atmosphere.

SUMMARY OF THE INVENTION

The present invention comprises a depressurization apparatus that utilizes a plurality of rupturable discs which are connected to lines that communicate with the conduit conveying hot gas from the combustion chamber of a pressurized fluid bed reactor. The conduit is connected to a turbine for utilizing the hot gases to drive a generator or compressor. Depressurization of the turbine and/or the fluid bed reactor pressure vessel is achieved by electrically firing one or more of the rupturable discs to vent the hot gas through a stack and ultimately to the atmosphere.

Each rupturable disc is separated from the hot gas conduit by a normally opened isolation valve. After one of the discs is ruptured to relieve the pressure in the conduit, its isolation valve can be closed to facilitate replacing the ruptured disc. In the meantime, the one or more additional rupturable discs with their isolation valves open are still connected to the hot gas conduit to vent any high pressures which may occur while the ruptured disc is being replaced. The depressurization apparatus is thus always available without having to shutdown the pressurized fluid bed reactor for any length of time. During depressurization of the fluid bed reactor pressure vessel, the resulting flow of hot gases follows essentially the same path through the pressurized fluid bed as it would during normal operation with the result that sufficient air is drawn through the pressurized fluid bed to burn out any remaining fuel and considerably cool the bed material during the brief period of depressurization.

An object of the invention is to provide a depressurization apparatus which can be automatically activated when the pressure sensed in the hot conduit exceeds that which has been selected as commensurate with safe operation.

Another object of the invention is to provide a depressurization apparatus which can be activated at will so as to permit depressurization for reasons other than excessive pressure.

A further object of the invention includes the elimination of blowoff valves which must be opened under conditions involving hot gas and relatively high dust loading with the risk that such blowoff valves may fail to open under emergency conditions. According to the invention, electrically fired rupturable discs are provided in conjunction with normally open isolation valves. The rupturing operation is far less likely to fail than the emergency opening of a blowoff valve.

Yet another object of the invention is the use of plural rupturable discs which allows an immediate restarting of the pressurized fluid bed system and on-line replacement of the spent or ruptured disc. Once replaced, the full pressure relieving capacity of the depressurization apparatus is restored by opening the isolation valve for the replaced disc.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only drawing in the application is a schematic diagram of the inventive depressurization apparatus connected to a pressurized fluid bed system.

DESCRIPTION OF THE PREFERRED EMBODIMENT

Referring to the drawing in particular, the invention therein comprises a depressurization apparatus connected to a conduit 1 which carries hot exhaust gases from the combustion chamber of a pressurized fluid bed system having a pressure vessel 6. The hot gases from conduit 1 are normally supplied to a turbine 4 for turning a compressor, generator or other load.

The pressure in hot gas conduit 1 is monitored by a pressure transducer 10 which sends a signal to a pressure controller 9. Upon the occurrence of excessive pressure which would tend to damage the turbine 4, controller 9 electrically fires one of the rupturable discs 2. If excessive pressure persists or reoccurs, controller 9 will electrically fire additional rupturable discs 2.

The pressure controller 9 is also capable of receiving a signal from a source, not shown, other than the pressure transducer 10 with such signal being transmitted at will so as to permit depressurization reasons other than excessive pressure.

Commercially available rupturable discs, can be otained from Fike Metal Products Corporation of Blue Springs, Mo., BS & B Safety Systems of Tulsa, Okla. and other manufacturers.

Each rupturable disc 2 is separated from the hot gas conduit 1 by a normally open isolation valve 3 provided in a vent line 11 connected to the conduit 1. Once a disc has been ruptured, its isolation valve is closed. The ruptured disc can then be replaced by a new disc. When the new disc is in place, its isolation valve is opened to re-establish communication with the hot gas conduit 1.

The hot gas which is discharged, when disc 2 is ruptured, passes through a vent stack 7 and is thence conveyed to the atmosphere shown schematically at 6. A normally open isolation valve 8 may also be provided in the vent stack 7 on the discharge side of each rupturable disc 2. This avoids exposure to hot gases which may exist in the stack if a subsequent emergency condition causes the electric firing of an additional disc, while the first ruptured disc is being replaced.

While a specific embodiment of the invention has been shown and described in detail to illustrate the application of the principles of the invention, it will be understood that the invention may be embodied otherwise without departing from such principles.

The invention claimed is:

1. A depressurization apparatus for a pressurized fluid bed system generating hot gases, comprising;

a conduit connected to the system for conveying the hot gases to a load;

a plurality of vent lines connected to the conduit for venting gas from the conduit;

a normally open isolation valve in each vent line;

a vent stack connected to each vent line for venting hot gas passing through each vent line;

a rupturable disc for each vent line separating each vent line from the stack; and means for rupturing at least one of the rupturable discs in the conduit thereby venting gas from the conduit, the isolation valve being closable to facilitate replacement of said ruptured disc.

2. An apparatus according to claim 1, including a turbine connected to the conduit for receiving the hot gas from said conduit.

3. An apparatus according to claim 1, including a further normally open isolation valve for each rupturable disc, each further isolation valve being disposed in the stack, downstream of its respective rupturable disc, said first-mentioned and further isolation valves being closable after the rupturing of a respective rupturable disc for isolating the ruptured disc, both from the conduit and from the stack for replacement of said ruptured disc.

4. An apparatus according to claim 1, wherein the means includes a controller for selectively rupturing at least one of the rupturable discs upon the occurrence of a selected high pressure in said conduit.

5. An apparatus according to claim 4, wherein the controller comprises a pressure sensor connected to the conduit for sensing pressure therein and electric firing means for sensing the occurrence of the selected high pressure in the conduit and electrically firing at least one of said rupturable discs.

* * * * *